United States Patent [19]

Valentijn

[11] 4,035,200

[45] July 12, 1977

[54] PROCESS FOR MAKING AN OXIDE-LAYER

[75] Inventor: Jaques Hubert Valentijn, Nijmegen, Netherlands

[73] Assignee: Smit Ovens Nijmegen B.V., Nijmegen, Netherlands

[21] Appl. No.: 603,369

[22] Filed: Aug. 11, 1975

[30] Foreign Application Priority Data

Aug. 23, 1974 Germany ..... 2440447

[51] Int. Cl.[2] ..... C23C 11/08

[52] U.S. Cl. ..... 148/6.35; 148/16; 148/6.3; 427/248 E

[58] Field of Search ..... 148/6.35, 6.3, 16; 427/248; 73/19, 23

[56] References Cited

U.S. PATENT DOCUMENTS

| | | | |
|---|---|---|---|
| 2,269,943 | 1/1942 | Kiser | 148/6.35 |
| 2,398,012 | 4/1946 | Kiser | 148/6.35 |
| 2,543,710 | 2/1951 | Schmidt et al. | 148/6.35 |
| 3,368,386 | 4/1964 | Harvey | 73/23 |
| 3,398,481 | 8/1968 | Lake | 73/23 |
| 3,708,351 | 1/1973 | Dallas et al. | 148/6.35 |
| 3,932,246 | 1/1976 | Stodler et al. | 73/19 |

*Primary Examiner*—Ralph S. Kendall
*Assistant Examiner*—Charles R. Wolfe, Jr.
*Attorney, Agent, or Firm*—Fitch, Even, Tabin & Luedeka

[57] ABSTRACT

A blackening process of producing an oxide layer consisting predominantly of $Fe_3O_4$ on an iron surface in an oxidizing atmosphere and at a temperature of from 500° to 650° C, whereby the oxidizing atmosphere is produced by understoichiometrically burnt fuel gas without removal of water from the combustion gases. In the combustion chamber, the apparent reaction temperature is controlled by cooling to provide an apparent reaction temperature of from 500° to 800° C. The combustion products are conducted into a heated blackening chamber at a temperature substantially above the dew point of the combustion products. The CO characteristic of the combustion gases is monitored and is used to control the air and fuel supplies.

3 Claims, 4 Drawing Figures

PROCESS FOR MAKING AN OXIDE-LAYER

The present invention relates to a process of producing a blacking oxide layer consisting primarily of $Fe_3O_4$ on an iron surface by treatment in an oxidizing atmosphere at a temperature of above 500° C, whereby the oxidizing atmosphere is formed by fuel gas burnt in understoichiometrical quantities.

In the so-called blackening process, also termed inoxidation, iron is coated with an oxide layer which is formed in an oxidizing atmosphere by annealing of the iron; this oxide layer is contemplated to consist predominantly of the intermediate oxide $Fe_3O_4$ which forms a blackish protective coating. The blackening is performed at a temperature of between 500° and 650° C, whereby the oxiding atmosphere is produced by gas burnt in understoichiometric quantities (air ratio n between 0.9 and 0.99; n = 1 in a stoichiometric combustion). The composition of the furnace gases has a great bearing on the formation of the oxide layer. According to MACHU (Nichtmetallische anorganische Uberzuge, published by Springer-Verlag, Vienna, 1952, pages 142 to 144), best results are obtained when the furnace gases have maximum capability of reduction and when these gases are free of molecular oxygen. Likewise, the $CO_2$ content must not exceed a predetermined, relatively low maximum value. Formation of the layer commences at an annealing temperature of about 560° C and is highest at temperatures of from 800° to 900° C. At these temperatures, the layers formed also show the highest gloss or brilliancy and the deepest blue. At a temperature higher than 900° C, the coating tends to form blisters so as to peel off.

It is known (U.S. Pat. 3,708,351) to produce the oxidizing gas atmosphere in a combustion chamber lined with refractory material. According to applicant's experience, the temperature within the combustion chamber is about 1000° C. During the combustion, substantial quantities of $H_2O$ are produced, part of which is superflous. That is, as explained in greater detail below, the blackening must be effected in an accurately defined atmosphere having predetermined $H_2O/H_2$ or $CO_2/CO$ ratios, respectively. Such atmosphere cannot be provided directly with the combustion gases as formed in the known process, because the proportion of $H_2O$ is too high. Therefore, the combustion gases are passed through a cooler having a cooling water circuit wherein the surplus water is condensed and drained. Control of the dehydration is performed by adjustment of the dew point. The latter is between 45° and 50° C. The desired dew point adjustment can be controlled by controlling the outlet temperature of the cooling water. In practice, the temperature of the cooling water leaving the cooler is kept at about 5° C above the dew point.

The conventional manner of the gas production and dehydration suffers from several disadvantages: An expensive separate cooler is required for the water separation, while the combustion chamber must be provided with a lining. Great volumes of water are necessary for cooling purposes.

Due to the high water contents of the thus produced gas, the dew point of such gas is very high. Accordingly, water volumes are condensed or separated not only within the cooler, but also in the conduits. Therefore, additional installations are required to avoid such water condensation. Additionally, a relatively high proportion of nitric oxides ($NO_x$) is formed because of the high temperature of combustion, which nitric oxides in combination with the aforementioned condensed water result in oxidation and thus in corrosion of the conduits and of the cooler. The oxidation and corrosion products contaminate the conduits and the surface of the iron to be blackened. Besides, the lining of the combustion chamber is subject to relatively rapid wear due to the high temperatures. Dislodged particles of the lining may contaminate the iron products. Accordingly, it is common practice to replace the refractory lining approximately once a year, this resulting in high cost.

Consequently, the following objects should be solved in order to improve this process:

a. To avoid the abovementioned drawbacks of the conventional process;
b. to simplify the apparatus required for carrying out the process and to lower the cost of maintenance of such apparatus;
c. to render possible the provision of an apparatus in which the process of the blackening and of the gas production can be performed in a substantially integrated manner within a single chamber.

Whereas MACHU (compare the above reference) reveals only qualitative statements about the conmposition of the gas atmosphere, U.S. Pat. No. 3,708,351 specifies the following composition of the gas mixture after the combustion (upon removal of water):

Table I

| | | |
|---|---|---|
| Oxidizing gases | $CO_2$ | 11 to 12% |
| | $H_2O$ | 1 to 2% |
| Reducing gases | CO | 1 to 3% |
| | $H_2$ | 1 to 3% |
| Inert gases | $N_2$ | 80 to 86% |

Air and live steam are added to this gas such that thereafter the following mixture is obtained within the reaction chamber:

Table II

| | | |
|---|---|---|
| Oxidizing gases | $CO_2$ | 10 to 11% |
| | $H_2O$ | 2 to 3% |
| | $O_2$ | 0.5 to 2% |
| Reducing gases | CO | 1 to 3% |
| | $H_2$ | 1 to 3% |
| Inert gases | $N_2$ | 80 to 86% |

Accordingly, a part of the removed water is added again to the combustion gases in order to return the contents to the desired value. This prior mode of process can be avoided according to the invention by solving the abovementioned objects, when the fuel gas is burnt at an apparent reaction temperature of from 500° to 800° C and the combustion products are thereafter passed to a heated blackening chamber at a temperature substantially above the dew point.

Thus, the present process steps include the requirements that no water is separated from the combustion products on their way from the combustion chamber to the reaction chamber. The gas mixture is maintained in its entirety whereby, as known, reactions take place between the gases in correspondence with their temperature. In particular, no $H_2O$ is separated.

The blackening step per se should be performed in an atmosphere the CO content of which is maintained constant. According to experience, the combustion in the combustion chamber may be conducted in optimum manner if the apparent reaction temperature is kept at about 750° C. The apparent reaction temperature is that temperature which results for a given $CO_2$/-

$CO—H_2O/H_2$ ratio from a diagram attached to this specification as FIG. 4. The actually measured temperature at separate points of the combusion chamber may differ from this apparent reaction temperature.

Actually, U.S. Pat. No. 3,708,351 also indicates that the addition of live steam can be avoided by carefully controlling the combustion and subsequent immediate cooling. However, this patent includes the reservation that the conduits between the combustion chamber and the blackening furnace should then be insulated or heated, such that condensation within the conduits is avoided. However, this reference does not provide a way towards the qualitative statements with respect to the combustion temperature and the handling of the combustion gases as proposed according to the present invention.

The desired volume and temperature conditions may be controlled or kept constant quite easily when the composition of the combustion product can be controlled through a control circuit or loop which comprises essentially a CO sensor and a device controlling the gas supply and operated by the measured value of the CO sensor. As known, for the gas atmosphere in question it is substantially easier to measure or control, respectively, the CO content, than the dew point. Besides, it is possible to control the system by means of measuring the total of the still combustible components present, i.e. by means of measuring the total proportion of $CO + H_2$. Recently, measuring instruments are available to this end which make this type of measurement and control to be particularly economical (compare the company publication MSA Modes T.C.G.A. of the firm MSA, Italiana s.p.a.).

In this way, the novel process results in a great simplification of the overall assembly for the blackening of metallic parts. The novel assembly merely comprises a combustion chamber adapted to be cooled and which communicates with a reaction chamber via a lightly heat-insulated, unheated conduit. Upon exit from the combustion chamber, the gases have a temperature of, for instance, from about 200° to 300° C, which temperature is well above the dew point and does not fall below this value even during the conveying of the gas to the blackening chamber when conduit is just lightly insulated. Accordingly, highly insulated or heatable conduits can be dispensed with, which fact likewise means a substantial simplification and lowering of the cost of the system.

In an advantageous embodiment, the apparatus for carrying out the method of the invention may have one (or more) combustion chamber (chambers) disposed directly adjacent the reaction chamber, because cooling installations and accumulating means for the condensed water can be omitted. Furthermore, the combustion chambers may be arranged immediately within the reaction chamber such that the reaction gas is produced in the immediate vicinity of the products to be blackened.

Furthermore, properties and advantages of the method and of the apparatus according to the invention are explained in greater detail by referring to the drawings, wherein.

Figure 1:
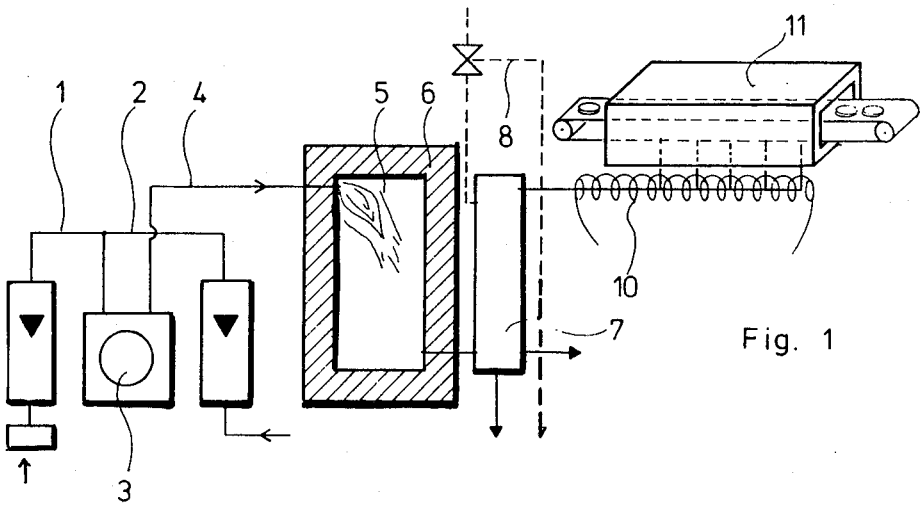
FIG. 1 shows an arrangement for carrying out the process of the prior art.

FIG. 1 shows schematically a constructional arrangement for carrying out the process according to the prior art. Air and gas (natural gas, propane and the like) are fed through lines 1 and 2 to a mixing pump 3 and supplied into a combustion chamber 5 via a conduit or line 4. The combustion chamber is lined with a refractory brick layer 6. Within the combustion chamber 5, the gas is burnt with air (apparent reaction temperature about 1000° C). The ratio of gas and air is understoichiometric, i.e., the air ratio is between 0.9 and 0.99. CO, $CO_2$, $H_2O$ and $H_2$ are formed as reaction products; in addition, nitric oxides are formed at these high combustion temperatures. Part of the $H_2O$ is condensed out from the system by passing the combustion gas through a cooler 7 in which a predetermined cooling water outlet temperature of, for example, 45° to 50° C is maintained depending on the necessary dew point.

A cooling circuit 8 exists within the cooler 7, which cooling circuit is adapted to be controlled by means of the temperature of the cooling water. The quantity of water still present in the combustion gases after cooling thereof corresponds to a dew point of from about 45 to 50° C. The dew point is maintained by the temperature. It has been found that, due to this relatively high dew point, the water contained in the combustion gases still further condenses within the conduits such that corrosion occurs within these conduits, whereby nitric oxides and $CO_2$ greatly contribute to such corrosion. For this reason, as schematically shown, a heater 10 is arranged around the feed line. The gases must be maintained at a temperature of at least 50° C in order to avoid condensation. The greatly cooled gases must then be heated again to a temperature of above 500° C corresponding to the reaction temperature. Subsequently, the blackening process takes place within the oxidizing atmosphere.

Figure 2:
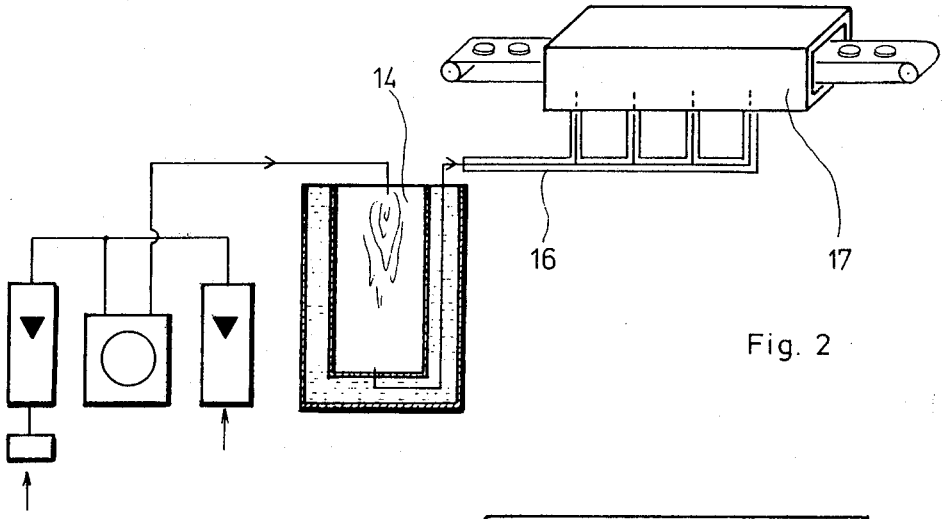
FIG. 2 shows an arrangement according to the invention.

In FIG. 2, the novel process according to the invention is illustrated in a similar view as in FIG. 1. In this case, too, a gas-air mixture is fed by a mixing pump 3 into a combustion chamber 14 and continuously burnt within the latter. The combustion chamber is provided with a cooling jacket 15 (water cooling). Such cooling substantially reduces the apparent reaction temperature, e.g. to a value of about 750° C. Thereupon, the gases are further passed through the cooling jacket (line 16) whereby these gases are cooled down to a temperature of e.g. from 200° to 300° C. The gases produced within the combustion chamber have been formed by combustion with the correct air ratio from the outset, such that a different operating point in the $CO_2/CO—H_2O/H_2$ diagram is obtained, as will be explained below. Due to the high outlet temperature of about 200° C, the relative humidity of these gases is substantially lower, such that the temperature cannot be fall below the dew point. Even during transport of the gases, the temperature would not fall below the dew point if the conduits are only provided with light thermal insulation. Heating can be dispensed with completely. This fact provides for substantial savings in the novel process, too.

Figure 3:
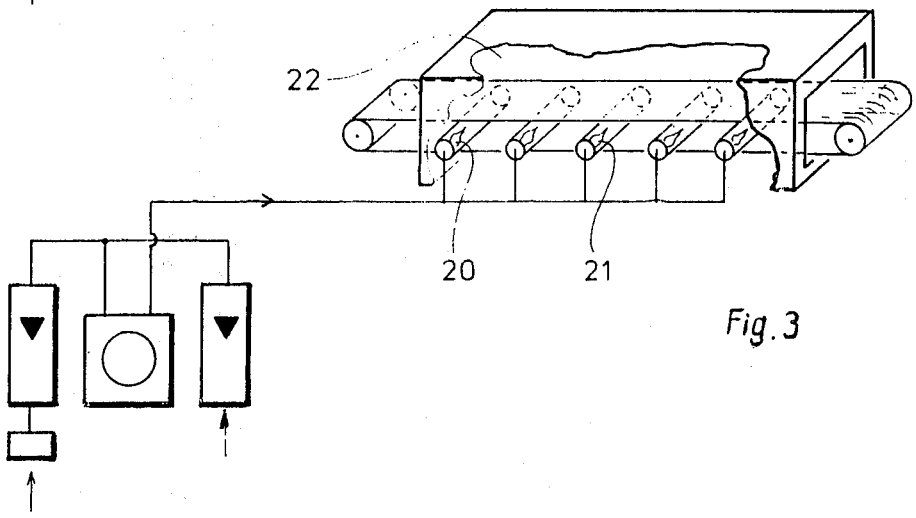
FIG. 3 shows another embodiment of an apparatus according to the invention.

The cooled fuel or heating gases are passed to a reaction chamber 17 wherein these gases are heated back to the temperature required for oxidation. The oxidation can be performed either continuously or with individual batches each. Furthermore, the novel process lends itself to completely different embodiments. A specific embodiment is schematically shown in FIG. 3. Hereby, the gas-air mixture is fed for combustion into separate combustion chambers 20, 21 spaced across the length of the reaction chamber. In this construction, the oxidizing gas mixture flows directly from the approximately cylindrical combustion chambers into the reaction space or chamber 22. In this latter embodiment, there are thus eliminated the feed lines with their unavoidable heat losses. Besides, the combustion heat may be utilized for heating purposes. Further, due to the spaced distribution of the combustion chambers, a uniform spatial division of the reaction zones can be obtained. Combinations of the embodiments according to FIG. 2 and FIG. 3 are likewise possible. For example, the combustion chamber 21 may be slightly cooled to obtain the desired apparent reaction temperature. Further, a single combustion chamber may be provided adjacent to the reaction chamber.

Figure 4:
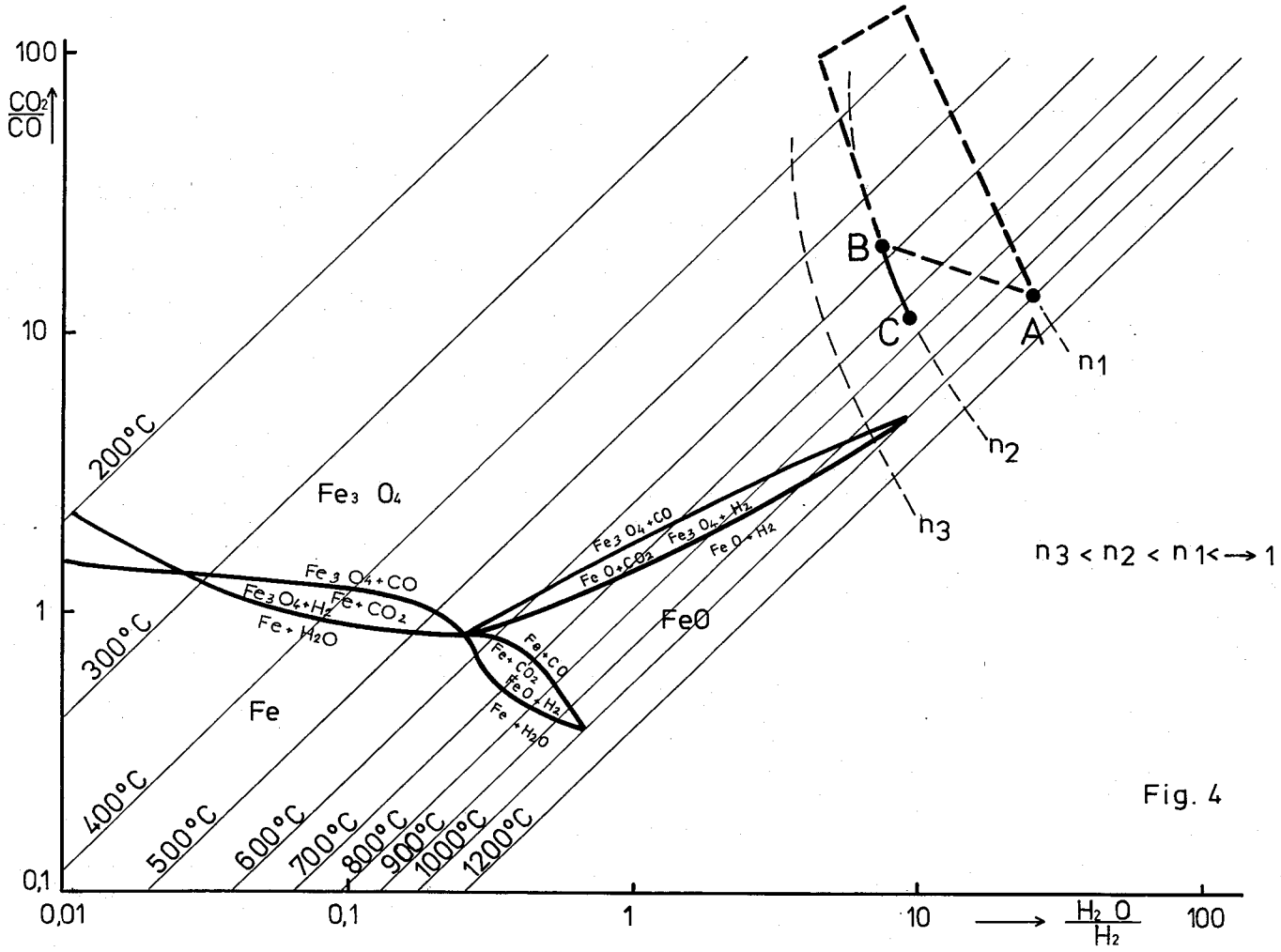
FIG. 4 is a $CO_2/CO$ through $H_2O/H_2$ mass ratio diagram showing the equilibrium states of the iron/various iron oxide modification.

FIG. 4 is a $CO_2/CO—H_2O/H_2$ diagram wherein the equilibrium iron-iron oxide modifications are shown. When using, for example, natural gas as the fuel gas, then in the known process the combustion starts at point A (temperature 1000° C). Hereby, the above-mentioned temperature is an apparent reaction temperature; in fact, the gases pass through various temperature stages in the combustion. The understoichiometric reaction gas produced is partially dehydrated by cooling. When re-heated, the gas reaches point B (580° C). The lastmentioned temperature corresponds e.g. to the operating temperature of the blackening process. Actually, the distance from point A to point B is not passed through directly, but rather indirectly via the dew point temperature, as indicated in the diagram of FIG. 4 by the broken line.

On the other hand, in the novel process the combustion starts not before point C (apparent reaction temperature 750° C). Point B can be obtained by following a line with constant $n$ factor. Hereby, the lines designated with $n_i$ represent air ratios of gas mixtures which remain constant with respect to their total mass. The temperature is always substantially above the dew point of the combustion gases. Again, when point B is reached, the desired conditions for the blackening process are obtained. Heating and cooling are effected without removal of a gas portion with a constant total mass.

The gas composition or mixing by means of the mixing pump is controlled by a control circuit which comprises a CO probe as a sensor. The measured value provided by this probe controls the ratio between gas and air in such a way that the admixed volume of air is reduced in the case of insufficient quantities of CO which indicate an excessive volume of air. As the measuring probe, in infra-red analyzer may be used. Hereby, the circuit arrangement and the determination of the measuring location are left to the expert's discretion. Control can be effected manually, too.

Reference may be made to the fact that the hot combustion gases from the combustion chamber may be introduced directly into the reaction chamber. However, in case that the heating must be conveyed over a certain distance, then it is advisable for reasons of safety, for reasons of conduit wear and the like to cool the hot combustion gases to a transport temperature of from 200° to 300° C.

What is claimed is:

1. A process of producing an oxide layer consisting predominantly of $Fe_3O_4$ on an iron surface in an oxidizing atmosphere and at a temperature between 500° to 600° C. whereby the oxidizing atmosphere of combustion gases is produced by understoichiometrically burnt natural fuel gas or other fuel gases producing CO when burnt, comprising the following process steps:

a. controlling the combustion of the fuel gases by cooling the combustion chamber to maintain an apparent reaction temperature of from 500° to 800°C. in the combustion chamber to form the combustion gases;

b. without cooling to remove water from said combustion gases subsequently conveying the latter into a heated blackening chamber while maintaining constant the mass of the combustion gases and maintaining the temperature substantially above the dew point of the combustion gases;

c. producing a blackened oxide layer on the iron surface in the blackening chamber by contacting the iron surface with the combustion gases; and d. monitoring the proportion of CO in the combustion gases after burning of the gases producing CO with a sensing means and controlling the air and fuel supplies by a control means in accordance with the measured values of the CO concentration.

2. The process according to claim 1, wherein the step of controlling the combustion of fuel gases includes cooling the combustion chamber so that the combustion takes place at an apparent reaction temperature of about 750° C.

3. The process according to claim 1, including the further step of cooling the combustion gases to a temperature of from 200° to 300° C. after the combustion of such gases.

* * * * *